United States Patent [19]

Kuijk

[11] Patent Number: 4,794,385

[45] Date of Patent: Dec. 27, 1988

[54] DISPLAY ARRANGEMENT WITH IMPROVED DRIVE

[75] Inventor: Karel E. Kuijk, Eindhoven, Netherlands

[73] Assignee: U.S. Philips Corp., New York, N.Y.

[21] Appl. No.: 910,103

[22] Filed: Sep. 22, 1986

[30] Foreign Application Priority Data

Sep. 30, 1985 [NL] Netherlands ..... 8502662

[51] Int. Cl.[4] ..... G09G 3/02

[52] U.S. Cl. ..... 340/719; 340/784; 340/785; 340/787

[58] Field of Search ..... 340/805, 784, 785, 787, 340/775, 825.94, 825.81, 825.82, 718, 719; 350/332, 333, 331 R

[56] References Cited

U.S. PATENT DOCUMENTS 3,654,606 4/1972 Marlowe et al. ..... 350/332

4,251,136 2/1981 Miner et al. ..... 340/784

4,554,537 11/1985 Dick ..... 340/775

OTHER PUBLICATIONS

"Liquid Crystal Matrix Displays", B. J. Lechner et al, Proc. IEEE, vol. 59, No. 11, Nov. 1971, pp. 1566–1579.

*Primary Examiner*—Marshall M. Curtis

*Assistant Examiner*—Mahmoud Fatahi-Yar

*Attorney, Agent, or Firm*—Bernard Franzblau

[57] ABSTRACT

A display arrangement (LCD etc.) in which the control voltage range is enlarged by including in the control lines (13$^a$, 13$^b$) additional diodes (14) which are connected to a common point (15). In order to counteract a capacitive by-effect, additional diodes (17) are connected in parallel with opposite polarity. The enlarged control range provides a wider choice of LCD material or other electrooptical materials.

10 Claims, 3 Drawing Sheets

DISPLAY ARRANGEMENT WITH IMPROVED DRIVE

BACKGROUND OF THE INVENTION

This invention relates to a display arrangement comprising an electro-optical display medium positioned between two supporting plates, a system of picture elements arranged in rows and columns, each picture element being constituted by two picture electrodes provided on the surfaces of the supporting plates facing each other, a system of row and column electrodes for driving the picture elements, the row electrodes being provided on one supporting plate and the column electrodes being provided on the other supporting plate, and a system of switching elements, at least one first asymmetrical non-linear switching element being arranged between a first row electrode and a column electrode in series with each picture element and at least one additional asymmetrical non-linear switching element being arranged in series with the first asymmetrical non-linear switching element between the first row electrode and a second row electrode. The additional switching element is connected in the same direction as the first asymmetrical non-linear switching element between the picture element and the second row electrode.

It should be noted that in the present Application the terms "row electrode" and "column electrode" may be interchanged so that, where a row electrode is concerned, also a column electrode may be meant while simultaneously changing column electrode into row electrode. The term "asymmetrical" non-linear switching element" is to be understood to mean in this Application, in the first instance a diode usual in the technology for manufacturing the said display arrangements, such as, for example, a pn diode, a Schottky diode or a PIN diode made of monocrystalline, polycrystalline or amorphous silicon, CdSe or other semiconductor materials, although other types of non-linear switching elements, such as, for example, bipolar transistors with a shortcircuited base-collector junction or MOS transistors whose gate is connected to the drain zone, are not excluded.

Such a display arrangement is suitable for displaying alpha-numeric video information by means of passive electro-optical display media, such as liquid crystals, electrophoretic suspensions and electrochrome materials.

The known passive electrooptical display media generally have an insufficiently steep threshold with respect to the applied voltage and/or have an insufficient intrinsic memory. In multiplexed matrix display arrangements, these properties result in that, in order to obtain a sufficient contrast, the number of lines to be driven is limited. Due to the lack of memory, the information supplied to a selected row electrode via the column electrode has to be written again and again. Moreover, the voltages supplied at the column electrodes are applied not only across the picture elements of a driven row electrode, but also across the picture elements of all the other rows. Thus, for the time in which they are not driven, the picture elements are subjected to an effective voltage which must be sufficiently small so as not to bring a picture element into the ON state. Furthermore, with an increasing number of row electrodes, the ratio of the effective voltage to which a picture element is subjected in the ON and OFF state, respectively, decreases. Due to an insufficiently steep threshold, the contrast between picture elements in the ON and OFF state then decreases.

It is known that the number of rows to be driven can be increased by providing, per picture element, an additional switching element. This switching element ensures that a sufficiently steep threshold is obtained with respect to the applied voltage and ensures that the information supplied to a driven row electrode is maintained across a picture element for the time in which the remaining row electrodes are driven. The switching element also prevents a picture element from being subjected to an effective voltage meant for other picture elements in the same column for the time in which it is not driven.

A display arrangement of the kind mentioned in the opening paragraph is described in the article "Liquid Crystal Matrix Displays" by B. J. Lechner et al, published in Proc. I.E.E.E., Vol. 59, No. 11, November 1971, p. 1566–1579, more particularly p. 1574.

The arrangement shown therein and the associated method of driving, designated as the ac-$D^2C$ method, have the advantage that by means of unilateral non-linear switching elements (diodes), nevertheless an alternating voltage is obtained across the picture elements. However, this is at the expense of a second row electrode, to which the desired voltages are supplied by means of additional circuits.

SUMMARY OF THE INVENTION

An object of the present invention is to provide such a display arrangement, in which measures are taken to avoid these additional circuits so that the number of driving points can be practically halved as compared with the display arrangement with ac-$D^2C$ drive described in the aforementioned publication. A further object is to provide a wide choice in the electrooptical materials to be used.

A display arrangement according to the invention is for this purpose characterized in that the first row electrode is connected via a first number of asymmetrical non-linear switching elements of the same polarity connected in series with the first asymmetrical non-linear switching element and the second row electrode is connected via a second number of asymmetrical non-linear switching elements of the same polarity connected in series with the additional asymmetrical non-linear switching element to a common connection.

The invention is based inter alia on the recognition of the fact that a great voltage difference can be obtained across a picture element (and hence a wide choice in the electrooptical materials to be used, such as, for example, liquid crystals) by connecting per row electrode between the first or the additional switching element and a common connection point one or more switching elements in series with this first or additional switching element.

Although this first embodiment of a display arrangement according to the invention yields very favourable results with a small number of picture elements, it was found that, when larger numbers of picture elements are used, due to capacitive cross-talk row electrodes can be charged or discharged to such voltages that picture elements connected thereto display wrong information.

In order to avoid this, a preferred embodiment of a display arrangement according to the invention is characterized in that, parallel to both the first number of asymmetrical non-linear elements and to the second number of asymmetrical non-linear elements, at least one asymmetrical non-linear element with opposite polarity is connected.

It is also possible to cause a number of identical asymetrical non-linear switching elements to convey current both for the periods in which the first switching element is conducting and for the period in which the additional switching element is conducting.

A particular embodiment of a display arrangement according to the invention is for this purpose characterized in that each of the row electrodes is connected via at least one asymmetrical non-linear switching element of opposite polarity to a common point, while at least one series arrangement of a third number of asymmetrical non-linear switching elements each of the same polarity is arranged anti-parallel to these elements connected with opposite polarity and to the series arrangement of the first and the additional asymmetrical non-linear switching element.

BRIEF DESCRIPTION OF THE DRAWINGS

The invention will be described more fully, by way of example, with reference to a few embodiments shown in the drawing, in which.

DESCRIPTION OF THE PREFERRED EMBODIMENTS

Figure 1:
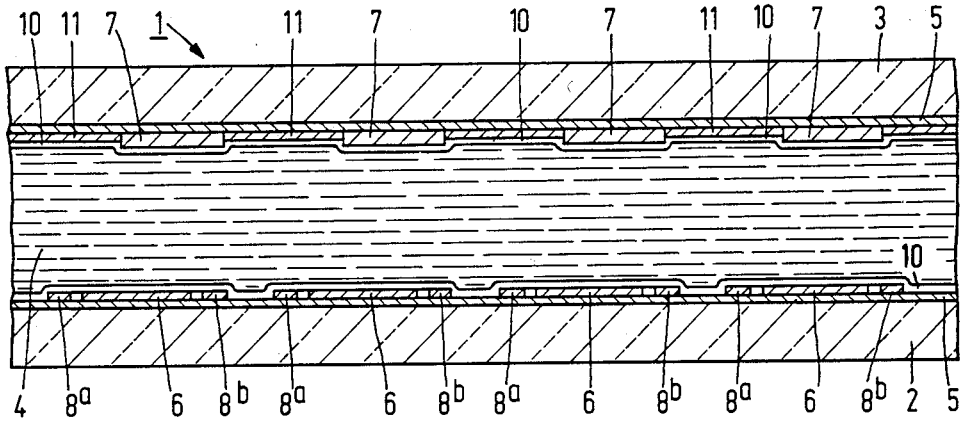
FIG. 1 shows diagrammatically in sectional view a part of a display arrangement of the type to which the invention relates.

FIG. 1 is a sectional view of a part of a display arrangement 1 provided with two supporting plates 2 and 3, between which a liquid crystal 4 is disposed. The inner surfaces of the supporting plates 2 and 3 are provided with electrical and chemical insulating layers 5. A large number of picture electrodes 6 and 7, arranged in rows and columns, respectively, are provided on the supporting plates 2 and 3. The oppositely arranged picture electrodes 6 and 7 constitute the picture elements of the display arrangement. Strip-shaped column electrodes 11 are arranged between the columns of picture electrodes 7. Advantageously, the column electrodes 11 and the picture electrodes 7 may be integrated to form strip-shaped electrodes. Strip-shaped row electrodes 8*a*, 8*b* are provided between the rows of picture electrodes 6. Each picture electrode 6 is connected to two row electrodes 8 by means of diodes 9*a*, 9*b*, not shown further in FIG. 1. The diodes 9 provide for the liquid crystal 4 a sufficiently steep threshold with respect to the applied voltage and provide a memory for the liquid crystal 4. Furthermore, liquid crystal orientating layers 10 are provided on the inner surfaces of the supporting plates 2 and 3. As is known, another state of orientation of the liquid crystal molecules and hence an optically different state can be obtained by applying a voltage across the liquid crystal layer 4. The display arrangement can be realized both as a transmissive and as a reflective arrangement.

Figure 2:
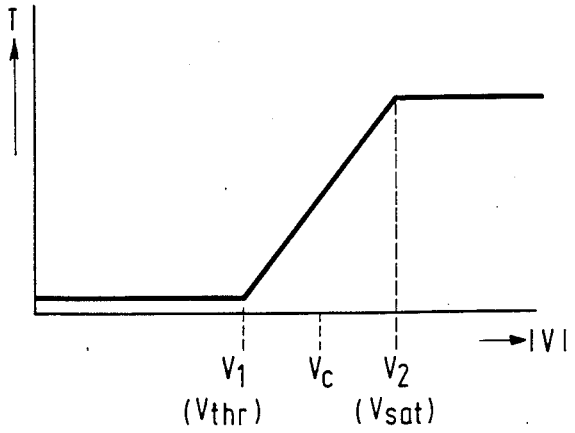
FIG. 2 shows diagrammatically a transmission/voltage characteristic of a display cell in such a display arrangement.

FIG. 2 shows diagrammatically a transmission/voltage characteristic of a display cell as used in the display arrangement of FIG. 1. Below a given threshold voltage ($V_1$ or $V_{th}$), the cell practically does not transmit any light, while above a given saturation voltage ($V_2$ or $V_{SAT}$) the cell is practically entirely translucent. It should be noted that, because such cells are generally operated with alternating voltage, the absolute value of the voltage is plotted on the abscissa.

Figure 3:
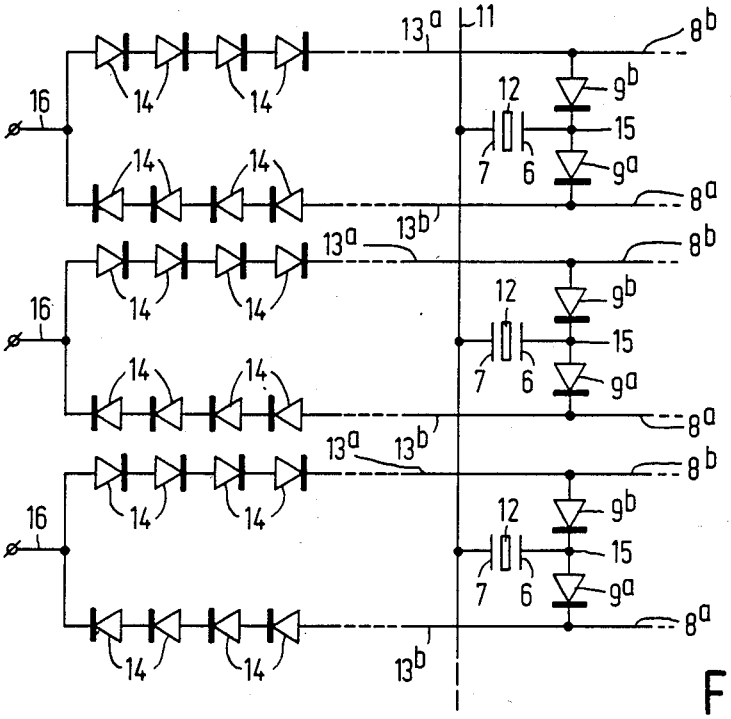
FIG. 3 shows diagrammatically a part of a control section according to the invention.

FIG. 3 shows diagrammatically a first embodiment of a part of a display arrangement according to the invention, especially a part of the control section. As described above, each picture element 12, forming part of, for example, a matrix, is connected on the one hand via the picture electrode 7 to a column electrode 11 and is connected on the other hand via the picture electrode 6 and two diodes 9*a* and 9*b* or other unilateral non-linear switching elements to two row electrodes 8*a*, 8*b*. As already described in the introduction, such a circuit, in which the display arrangement is controlled according to the ac-$D^2C$ method, gives rise to a doubling of the number of row connection points. In order to avoid this, according to the invention, the control lines 13 of the row electrodes 8*a*, 8*b* include a number of additional diodes $14^a$, $14^b$. These diodes $14^a$ and $14^b$, respectively, are connected in series with the diodes $9^a$ and $9^b$, respectively. The two series arrangements are in turn connected in parallel between a point 15 corresponding to the picture electrode 6 and a driving point 16.

Although the diodes 14 may be manufactured in a manner different from that in which the diodes 9 are manufactured, it is assumed hereinafter that the diodes 9, 14 have practically the same ON and OFF voltages. The ON voltage $V_{ON}$ is the voltage at which the current through the diode is sufficiently large to rapidly charge the capacitance associated with the picture element, while the OFF voltage $V_{OFF}$ is chosen so that the associated current is so small that the said capacitance is practically not discharged.

Let it be assumed that the number of diodes in the selection lines $13^a$, $13^b$ is equal and amounts to k. Upon selection, the voltage drop between the driving point 16 and the junction point 15 is then at least $(k+1)V_{ON}$. With a selected cell, a data voltage $|V_D|$ is supplied at the column electrode 11, where $O \leqq V_D \leqq V_{DMAX}$, so that the voltage difference across the picture element 12 is $V_D$, and $V_{ON}$ across the $(k+1)$ diodes 14, 9 is $(k+1)V_{ON}$. However, limitations are set to the data voltage because after one field period the picture element is generally operated with inverted voltages. The data voltage therefore has a value between $-V_{DMAX}$ and $V_{DMAX}$. Due to capacitive couplings between the picture electrodes 7, 6, a maximum voltage $V_{MAX}$ and a minimum voltage $-V_{DMAX}$ can then occur at the electrodes 6. In a frame period in which the point 16 is operated with negative voltages, a nonselected line receives a voltage O at the point 16. In order to avoid discharge of the electrode 6, it is then required that $V_{DMAX} \leqq (k+1)V_{OFF}$. A nonselected row, which still has to be written, receives at the point 16 a voltage $(k+1)V_{OFF}$. In such a row, the maximum voltage at the electrode 6 is $2V_{DMAX}$ and the minimum voltage is 0 so that it holds again that $V_{DMAX} \leqq (k+1)V_{OFF}$.

In a next field period in which the point 16 is operated with positive voltages and the data voltages lie between $-V_{DMAX}$ and 0, these voltages change their signs. Consequently, it holds that $|V_D| \leqq (k+1)V_{OFF}$.

As stated above, the maximum voltage across the picture element is $V_D$ with $0 \leqq V_D \leqq (k+1)V_{OFF}$. In such an arrangement, a wide choice is thus possible, especially in the kind of LCD liquid to be used, because by increase and decrease, respectively, of the number of diodes 14 the maximum voltage to be used across the picture element 12 is increased and decreased, respectively.

Although the arrangement shown consequently offers a wider choice in the optoelectronic material to be used, it was found that, especially with larger matrices of picture elements, capacitive cross-talk has an unfavourable influence. This is especially the case with the use of a control method in which for the average voltage across a picture element a value $$V_c = \frac{V_{SAT} + V_{TH}}{2}$$

(cf. FIG. 2) is chosen. In this method, the absolute value of the voltage across the picture element 12 remains practically limited to the range between $V_{TH}$ and $V_{SAT}$. This is described more fully in "A LCTV Display Controlled by a -Si Diode Rings" by S. Togashi et al in SID 84, Digest, p. 324–5. The said capacitive effect results in that under given conditions signal variations can occur at the row electrodes such that undesired charging or discharging via the diodes 14 can occur.

Figure 4:
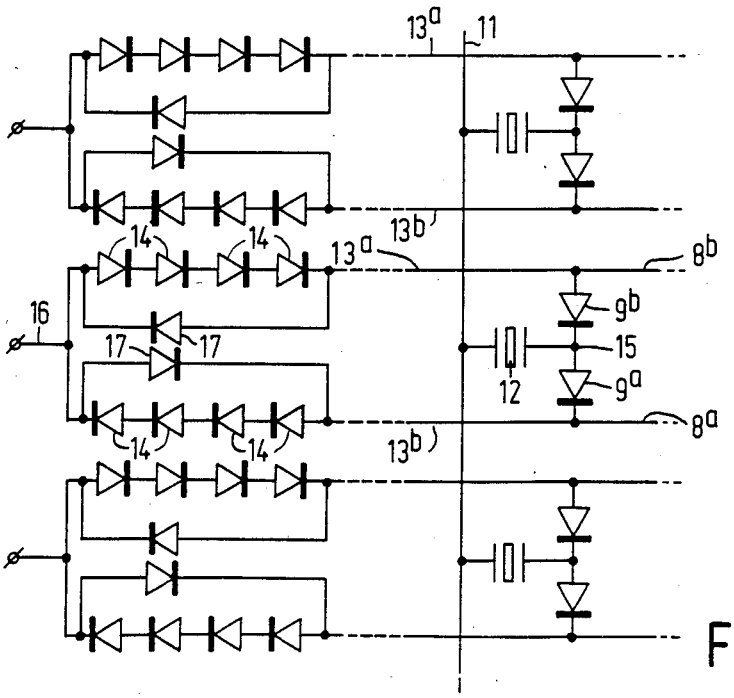
FIG. 4 shows diagrammatically a variation thereof.

FIG. 4 shows diagrammatically a part of a control device in which this disadvantage is met by connecting a diode 17 anti-parallel to the diodes 14. When the diodes 14 are switched off, the row electrodes 8 now do not assume an undefined voltage value, but these electrodes 8 assume, via the additional diodes 17, a voltage value which is higher or lower than the voltage at the point 16 by an amount equal to the forward voltage of the diode 17.

The current through the diode 17 can be a few times larger than that through the diodes 14 so that other ON and OFF voltages hold for the diodes 17. For the sake of completeness, other ON and OFF voltages will be given also for the diodes 14 hereinafter. With the aforementioned control above $V_C$ and with ON and OFF voltages $V_{ON}$ and $V_{OFF}$ for the diodes 9, $V'_{ON}$ and $V'_{OFF}$ for the diodes 14 (k in number), $V''_{ON}$ and $V''_{OFF}$ for the diodes 17, the following criteria are applied (FIGS. 2, 4):

$$2(V_{SAT}-V_{TH})=KV'_{OFF}+2V_{OFF}-V''_{ON} \quad \text{(a)}$$

$$|V_D|_{MAX}=\tfrac{1}{2}(V_{SAT}-V_{TH}) \quad \text{(b)}$$

$$V_{NON\text{-}SELECT}=V''_{ON}-V_{OFF}-V_{TH}+\tfrac{1}{2}(V_{SAT}-V_{TH}) \quad \text{(c)}$$

$$V_{SELECT}=-KV'_{ON}-V_{ON}-\tfrac{1}{2}(V_{SAT}+V_{TH}) \quad \text{(d).}$$

($V_{SELECT}$ and $V_{NON\text{-}SELECT}$ are the control voltages at the driving point 16).

These criteria can be seen as follows. In a drive according to the method of Togashi et al, upon selection the point 15 has to reach a voltage $V_C=\tfrac{1}{2}(V_{SAT}+V_{TH})$. A satisfactory operation is attained if, dependent upon the information at the column electrode 11, the capacitance constituted by the picture electrode is charged to $V_C+V_{DMAX}=V_{SAT}$ or to $V_C-V_{DMAX}=V_{THR}$. Elimination of $V_C$ from this relation give $|V_D|_{MAX}=\tfrac{1}{2}(V_{SAT}-V_{TH})$ (b). Upon selection of other picture elements, voltages between $-V_{DMAX}$ and $+V_{DMAX}$ can occur at the column electrode 11. Via capacitive coupling the maximum and minimum voltages at the junction point 15 are then $V_{MN}=-V_{DMAX}-V_{SAT}$ and $V_{MAX}=V_{DMAX}-V_{TH}$, respectively. In case of non-selection, the junction point 15 may then just not be charged and discharged, respectively, in other words $V_{NONSEL}-KV_{OFF}=V_{MIN}$ and $V_{NONSEL}-V''_{ON}+V_{OFF}=V_{MAX}$, respectively (1).

This gives $$KV'_{OFF}-V''_{ON}+2V_{OFF}=V_{MAX}-V_{MIN}=2V_{DMAX}+(V_{SAT}-V_{TH})$$

or $$2(V_{SAT}-V_{TH})=KV'_{OFF}+2V_{OFF}-V''_{ON} \quad \text{(a)}$$

It follows from the equations (1) (with $V_{MAX}=V_{DMAX}-V_{TH}$) that $$V_{NONSEL}=V''_{ON}-V_{OFF}-V_{TH}+\tfrac{1}{2}(V_{SAT}-V_{TH}) \quad \text{(c),}$$

while upon selection, the voltage $$V_{SEL}+KV'_{ON}+V_{ON}$$

must at least be equal to $V_{SAT}-V_C$ or $$V_{SEL}+KV'_{ON}+V_{ON} \geqq V_{SAT}-\tfrac{1}{2}(V_{SAT}-V_{TH})=\tfrac{1}{2}(V_{SAT}+V_{TH}) \rightarrow V_{SEL}=-KV'_{ON}=V_{ON}-\tfrac{1}{2}(V_{SAT}+V_{TH}) \quad \text{(d)}$$

Figure 5:
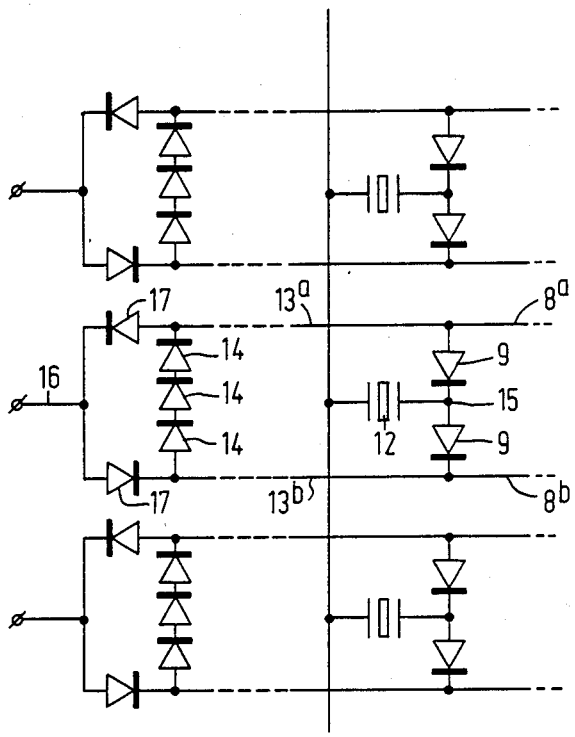
FIG. 5 shows diagrammatically a part of another control section according to the invention.

FIG. 5 shows an embodiment in which the charging current and the discharging current of the capacitances associated with the picture element 12 follow in part the same current path, i.e. a series arrangement of k diodes 14 (in this case k=3). In a similar manner as for the configuration of FIG. 4, it can again be derived that the following criteria hold:

$$2(V_{SAT}-V_{TH})=KV'_{OFF}+2V_{OFF} \quad \text{(e)}$$

$$|V_D|_{MAX}=\tfrac{1}{2}(V_{SAT}-V_{TH}) \quad \text{(f)}$$

$$V_{NONSEL}=V''_{ON}-V_{OFF}-V_{TH}+\tfrac{1}{2}(V_{SAT}-V_{TH}) \quad \text{(g)}$$

$$V_{SEL}=-V''_{ON}-KV'_{ON}-\tfrac{1}{2}(V_{SAT}+V_{TH}) \quad \text{(h)}$$

It now also holds again that upon selection the point 15 has to receive a voltage $V_C=\tfrac{1}{2}(V_{SAT}+V_{TH})$, while also $V_C+V_{DMAX}=V_{SAT}$ and $V_C-V_{DMAX}=V_{TH}$ have to be satisfied again. It holds then again for the point 15 that $$V_{MIN}=-V_{DMAX}-V_{SAT}$$

and $$V_{MAX}=V_{DMAX}-V_{TH}.$$

In the case of non-selection, the junction point 15 may not yet be charged and discharged, respectively, so that it holds that $$V_{NONSEL}-V''_{ON}+V_{OFF}=V_{MAX}$$

$$V_{NONSEL}-V''_{ON}-KV'_{OFF}-V_{OFF}=V_{MIN}.$$

This gives:

$$KV'_{OFF}+2V_{OFF}=V_{MAX}-V_{MIN}=2V_{DMAX}+(-V_{SAT}-V_{TH})$$

or $$2(V_{SAT}-V_{TH})=KV'_{OFF}+2V_{OFF} \quad \text{(e)}.$$

The criteria (f), (g) and (h) can now be derived in the same manner as above for (b), (c) and (d).

In this manner, the number of diodes in the periperhal electronic circuit can thus be considerably reduced (in the present example, while maintaining practically the same control voltage range across the picture element, the number of diodes is nearly halved with respect to the configuration of FIG. 4).

Figure 6:
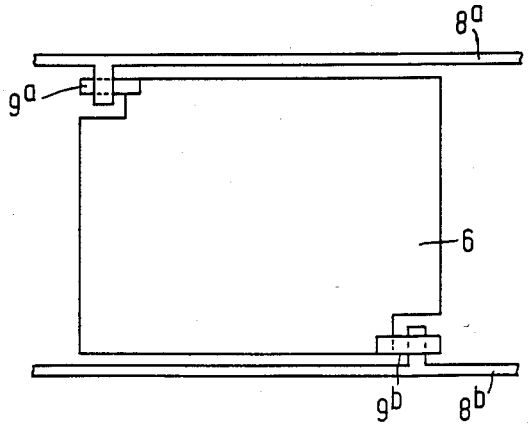
FIG. 6 shows diagrammatically a part of the electrode structure.

FIG. 6 finally shows in plan view a possible embodiment of the picture electrode 6, which is made, for example, of indium tin oxide. This electrode is connected through the diodes $9^a$, $9^b$, shown diagrammatically, to the aluminum row electrodes $8^a$, $8^b$. The diodes $9^a$, $9^b$ are made, for example, of amorphous silicon, which is contacted on the one hand on the upper side and on the other hand on the lower side by the electrodes $8^a$, $8^b$ (as the case may be via an intermediate layer) so that the desired polarity with respect to the picture electrode 6 is obtained. In order to obtain an increased reliability, it is of course possible to subdivide the picture electrode 6 into several subelectrodes, which are each connected via separate diodes $9^a$, $9^b$ to the row electrodes $8^a$, $8^b$ or to provide additional diodes $9^a$, $9^b$.

Of course the invention is not limited to the embodiments shown herein, but various modifications are possible within the scope of the invention. For example, in the configurations of FIGS. 4 and 5 diodes may be connected parallel to the diodes 17 in order to increase the reliability in operation. Such a parallel arrangement then again fulfils the function of a unilateral non-linear switching element. Furthermore, in the arrangement of FIG. 4, instead of one diode 17, two diodes may be connected in series, while the common point may be connected, if desired, to a point in the circuit of the diodes 14, which is thus connected antiparallel. Moreover, for example, the circuit of the diodes 14 in FIG. 5 may have a double construction. Besides its use in liquid crystal display arrangements, a switching matrix as described may also be used in other display media, such as, for example, electrophoretic and electrochrome display media.

What is claimed is:

1. A display arrangement comprising: an electro-optical display medium between first and second parallel opposed supporting plates, a first plurality of arrays of picture electrodes positioned on an inner surface of the first supporting plate and with said electrodes oriented normal with respect to a second plurality of picture electrodes positioned on an inner surface of the second supporting plate so as to form a matrix of picture elements, a system of row and column electrodes for driving the picture elements, the row electrodes being supported by said first supporting plate and the column electrodes being supported by said second supporting plate and being electrically connected to the picture element electrodes on the inner surface of said second support plate, at least one first asymmetrical non-linear switching element connected in series with at least one additional asymmetrical non-linear switching element between a first row electrode and a second row electrode and with a junction point between said first and said additional asymmetrical non-linear switching elements connected to a picture element electrode on the inner surface of said first supporting plate, said first and said additional switching elements being connected between said first and second row electrodes in the same direction, characterized in that the first row electrode is connected via a first number of asymmetrical non-linear switching elements of the same polarity connected in series with the first asymmetrical non-linear switching element and the second row electrode is connected via a second number of asymmetrical non-linear switching elements of the same polarity connected in series with the additional asymmetrical non-linear switching element to a common connection point.

2. A display arrangement as claimed in claim 1, characterized in that the first number of asymmetrical non-linear switching elements is equal to the second number of asymmetrical non-linear switching elements.

3. A display arrangement as claimed in claim 1 further comprising at least first and second asymmetrical non-linear switching elements connected with opposite polarity in parallel to the first and second number of asymmetrical non-linear switching elements, respectively.

4. A display arrangement as claimed in claim 1 wherein the electrooptical display medium is chosen from the group of materials consisting of a liquid crystal, an electrophoretic suspension and an electrochrome material.

5. A display arrangement as claimed in claim 2 further comprising a first asymmetrical non-linear switching element connected anti-parallel to the first number of asymmetrical non-linear switching elements and a second asymmetrical non-linear switching element connected anti-parallel to the second number of asymmetrical non-linear switching elements.

6. A display arrangement comprising an electro-optical display medium located between first and second parallel opposed supporting plates, a first plurality of arrays of picture electrodes positioned on an inner surface of the first supporting plate and with said picture electrodes oriented normal with respect to a second plurality of picture electrodes positioned on an inner surface of the second supporting plate so as to form a matrix of picture elements, a system of row and column electrodes for driving the picture elements, the row electrodes being supported on said first supporting plate and the column electrodes being supported on said second supporting plate and being electrically connected to the picture element electrodes on the inner surface of said second supporting plate, at least one first asymmetrical non-linear switching element connected in series with at least one second asymmetrical non-linear switching element between a first row electrode and a second row electrode and with a junction point between said first and second asymmetrical non-linear switching elements connected to a picture element electrode on the inner surface of said first supporting plate, characterized in that the first and second row electrodes are connected to a common connection point via respective first and second series connections each including at least one asymmetrical non-linear switching element of opposite polarity to its corresponding one of said first and second switching elements, and at least one series aiding arrangement of a third number of asymmetrical non-linear switching elements connected antiparallel to the first and second asymmetrical non-linear switching elements.

7. A display arrangement as claimed in claim 6, characterized in that the electrooptical display medium is a liquid crystal.

8. A display arrangement as claimed in claim 6, characterized in that the electrooptical display medium is an electrophoretic suspension.

9. A display arrangement as claimed in claim 6, characterized in that the electrooptical display medium is an electrochrome material.

10. A display arrangement as claimed in claim 6 wherein said system of row and column electrodes form a matrix of electrodes and said first and second asymmetrical non-linear switching elements are connected in series aiding configuration.

* * * * *